US006456312B1

(12) United States Patent
Oike

(10) Patent No.: US 6,456,312 B1
(45) Date of Patent: Sep. 24, 2002

(54) THERMAL HEAD, METHOD OF MANUFACTURING THE SAME, AND THERMAL STENCIL MAKING APPARATUS USING THE SAME

(75) Inventor: Hikaru Oike, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/650,819

(22) Filed: Aug. 30, 2000

(30) Foreign Application Priority Data

Aug. 31, 1999 (JP) ..... 11-245918

(51) Int. Cl.[7] ..... B41J 2/335
(52) U.S. Cl. ..... 347/205; 347/200
(58) Field of Search ..... 347/200, 205

(56) References Cited

U.S. PATENT DOCUMENTS 4,860,030 A * 8/1989 Pond et al. ..... 347/202
5,417,156 A 5/1995 Tateishi et al.

FOREIGN PATENT DOCUMENTS

JP 61-24465 * 2/1986
JP 6-115128 * 4/1994
JP 9-290522 * 11/1997

OTHER PUBLICATIONS

European Search Report dated Apr. 19, 2001.
Patent Abstracts of Japan, vol. 016, No. 208, May 18, 1992. & JP 04 033868 A Feb. 5, 1992.
Patent Abstracts of Japan, vol. 1998, No. 3, Feb. 27, 1998 & JP 09 290522 A Nov. 11, 1997.
Patent Abstracts of Japan, vol. 017, No. 002, Jan. 5, 1993 & JP 04 234 673 A Aug. 24, 1992.
Patent Abstracts of Japan, vol. 1997, No. 05, May 30, 1997 & JP 09 001846 A Jan. 7, 1997.

* cited by examiner

*Primary Examiner*—Huan Tran
(74) *Attorney, Agent, or Firm*—Nixon Peabody, LLP; Donald R. Studebaker

(57) ABSTRACT

A thermal head includes a heat radiating plate and an electrical insulating substrate which is provided with a plurality of resistance heater elements arranged in a direction over a predetermined length and a plurality of electrodes for energizing the resistance heater and is integrated with the heat radiating plate. The substrate is smaller than the heat radiating plate in coefficient of thermal expansion and is fixed to the heat radiating plate at a temperature higher than the normal working temperature range of the thermal head. In the normal working temperature range of the thermal head, the thermal head is convex toward the resistance heater in a cross-section taken along a line parallel to the direction in which the resistance heater elements are arranged due to the difference in coefficient of thermal expansion between the heat radiating plate and the substrate.

2 Claims, 4 Drawing Sheets

THERMAL HEAD, METHOD OF MANUFACTURING THE SAME, AND THERMAL STENCIL MAKING APPARATUS USING THE SAME

BACKGROUND OF THE INVENTION

1. Field of the Invention

This invention relates to a thermal head for thermally making a stencil for use in a stencil printer, a method of manufacturing such a thermal head and a thermal stencil making apparatus using such a thermal head.

2. Description of the Related Art

There has been known a stencil making apparatus having a stencil making section such as shown in FIG. 5. The stencil making section comprises a platen roller 3 having a metal support shaft 3*a* which is supported for rotation on a side frame (not shown) at its opposite ends and a thermal head 2 which is pressed against the platen roller 3 and is moved away from the platen roller 3 by a head pressing mechanism (not shown).

The thermal head 2 comprises a heat radiating plate 21, a ceramic substrate 22 fixed to the heat radiating plate 21, and a glaze layer 23 which is fixed to the surface of the ceramic substrate 22 and functions as a heat accumulating layer. An array of resistance heater elements 24 is formed on the surface of the glaze layer 23. The heater elements 24 are connected to electrodes and a drive circuit (which are not shown) and are selectively energized to thermally perforate a stencil material 4.

When making a stencil by imagewise perforating a stencil material 4, the stencil material 4 is fed between the thermal head 2 and the platen roller 3, and then the thermal head 2 is pressed against the platen roller 3 with the stencil material 4 intervening therebetween. With the thermal head 2 thus kept in a close contact with the stencil material 4, the resistance heater elements 24 are selectively energized to thermally perforate the stencil material 4. Thereafter, the platen roller 3 is rotated to bring the thermal head 2 in contact with another part of the stencil material 4 and the resistance elements 24 are selectively energized again to thermally perforate the stencil material 4. By repeating these steps, a stencil master is made.

There has been a problem that, since the platen roller 3 is supported only at opposite ends of the support shaft 3*a,* the platen roller 3 is deflected at the middle thereof as shown in FIG. 5 in an exaggerated scale, whereas the thermal head 2 is normally formed of highly rigid materials and is hardly deflected. The thermal head 2 cannot be pressed against the platen roller 3 under a sufficient pressure near the middle of the platen roller 3.

FIG. 6 shows the measured value of the pressure acting between the thermal head 2 and the platen roller 3 per unit area when the thermal head 2 is pushed toward the platen roller 3 under a predetermined force by the head pressing mechanism. As can be seen from FIG. 6, the pressure acting between the thermal head 2 and the platen roller 3 is low near the middle of the platen roller 3 as compared with near the ends of the same, which results in a higher probability of generating defective perforations near the middle of the stencil.

When the pressure under which the thermal head 2 is pressed against the platen roller 3 is reduced in order to suppress deflection of the platen roller 3, the probability of generating defective perforations is increased over the entire area of the stencil, which can result in deterioration in printing density.

Recently, there is a tendency to make larger the stencil, and, as the size of the stencil increases, the platen roller 3 must be larger in length, which results in an increased probability of generating defective perforations near the middle of the stencil.

There has been proposed a thermal stencil making apparatus in which a thermal head convex near the middle is used in order to suppress reduction in pressure between the platen roller 3 and the thermal head 2 due to deflection of the platen roller 3.

Conventionally, since such a convex thermal head has been formed, for instance, by pressing a convex heat radiating plate and fixing a ceramic substrate provided with resistance heater elements to the convex heat radiating plate, the degree of convexity of the thermal head obtained is governed by the state in which the ceramic substrate is fixed to the heat radiating plate, which makes it very difficult to obtain a desired degree of convexity of the thermal head.

Further, there has been known a convex thermal head which is formed by fixing a ceramic substrate to a flat heat radiating plate and then applying a pressure to the assembly of the heat radiating plate and the substrate to deform the assembly into a convex. However this method is disadvantageous in that it is necessary to control the pressure to be applied to the assembly according to the state in which the ceramic substrate is fixed to the heat radiating plate and accordingly it is very difficult to control the pressure to obtain a desired degree of convexity of the thermal head.

Further, intention to quickly deform the assembly of the heat radiating plate and the substrate into a convex is apt to result in breakage of the ceramic substrate and/or the glaze layer on the substrate. When the assembly is to be deformed by application of a pressure for a long time, though fear of breakage of the ceramic substrate and/or the glaze layer on the substrate is suppressed, productivity of the thermal head lowers and accordingly the manufacturing cost of the thermal head increases.

SUMMARY OF THE INVENTION

In view of the foregoing observations and description, the primary object of the present invention is to provide a thermal head which has a degree of convexity proper to compensate for the aforesaid deflection of the platen roller and can be manufactured at low cost.

Another object of the present invention is to provide a method of manufacturing such a thermal head.

Still another object of the present invention is to provide a thermal stencil making apparatus using such a thermal head.

In accordance with a first aspect of the present invention, there is provided a thermal head comprising a heat radiating plate and an electrical insulating substrate which is provided with a plurality of resistance heater elements arranged in a direction over a predetermined length and a plurality of electrodes for energizing the resistance heater and is integrated with the heat radiating plate, wherein the improvement comprises that the substrate is smaller than the heat radiating plate in coefficient of thermal expansion and is fixed to the heat radiating plate at a temperature higher than the normal working temperature range of the thermal head so that the thermal head is convex toward the resistance heater, in a cross-section taken along a line parallel to the direction in which the resistance heater elements are arranged, in the normal working temperature range of the thermal head due to the difference in coefficient of thermal expansion between the heat radiating plate and the substrate.

It is preferred that the end portions of the thermal head be lower than the middle portion of the same at least by 1/6000 of said predetermined length over which the resistance heater elements are arranged.

The electrical insulating substrate may be provided with a glaze layer not larger than 60 $\mu$m in thickness on the surface on which the resistance heater elements are provided.

In accordance with a second aspect of the present invention, there is provided a thermal stencil making apparatus comprising a thermal head and a platen roller against which the thermal head is pressed against with a stencil material intervening therebetween, wherein the improvement comprises that the thermal head comprises a heat radiating plate and an electrical insulating substrate which is provided with a plurality of resistance heater elements arranged in a direction over a predetermined length and a plurality of electrodes for energizing the resistance heater and is integrated with the heat radiating plate, and the substrate is smaller than the heat radiating plate in coefficient of thermal expansion and is fixed to the heat radiating plate at a temperature higher than the normal working temperature range of the thermal head so that the thermal head is convex toward the resistance heater, in a cross-section taken along a line parallel to the direction in which the resistance heater elements are arranged, in the normal working temperature range of the thermal head due to the difference in coefficient of thermal expansion between the heat radiating plate and the substrate.

The thermal stencil making apparatus of the present invention is especially useful when making a high resolution stencil not lower than 600 dpi. Further, it is preferred that the thermal head is pressed against the platen roller at a linear pressure not lower than 150 g/cm.

In accordance with a third aspect of the present invention, there is provided a method of manufacturing a thermal head comprising a heat radiating plate and an electrical insulating substrate which is provided with a plurality of resistance heater elements arranged in a direction over a predetermined length and a plurality of electrodes for energizing the resistance heater and is integrated with the heat radiating plate, the method comprising the steps of heating a heat radiating plate of metal and an electrical insulating substrate which is smaller than the heat radiating plate in coefficient of thermal expansion to a temperature higher than the normal working temperature range of the thermal head, and fixing the heated substrate to the heated heat radiating plate and cooling them so that the thermal head is convex toward the resistance heater, in a cross-section taken along a line parallel to the direction in which the resistance heater elements are arranged, in the normal working temperature range of the thermal head due to the difference in coefficient of thermal expansion between the heat radiating plate and the substrate.

As the electrical insulating substrate, an electrical insulating plate such as a ceramic plate may be used. The electrical insulating substrate may be provided with a glaze layer on the surface on which the resistance heater elements are provided. In this case, the glaze layer may be provided either over the entire area of the surface of the substrate or only a part of the same.

Thus, in accordance with the present invention, the thermal head is made convex by a difference in coefficient of thermal expansion between the heat radiating plate and the substrate. That is, when a substrate which is smaller in coefficient of thermal expansion than a heat radiating plate is fixed to the heat radiating plate at a temperature higher than the normal working temperature range of the thermal head, and the assembly of the heat radiating plate and the substrate is cooled to the normal working temperature range, the assembly is deformed to a smooth convex which is convex toward the surface of the substrate remote from the heat radiating plate, that is, the surface on which the resistance heater elements are provided, due to the difference in coefficient of thermal expansion, i.e., due to a so-called bimetal effect.

The degree of convexity of the thermal head can be easily controlled by suitably selecting the temperature at which the substrate is fixed to the heat radiating plate and accordingly a convex thermal head in a desired convexity symmetrical in the direction of arrangement of the resistance heater elements can be obtained. Further, since no external force is applied to the substrate during production of the thermal head, the substrate and/or the glaze layer cannot be broken and a convex thermal head can be obtained without necessity of a long processing time, a thermal head having a desired degree of convexity can be easily produced at low cost. Further, the glaze layer may be not larger than 60 $\mu$m in thickness.

When the degree of convexity of the thermal head is such that the end portions of the thermal head are lower than the middle portion of the same at least by 1/6000 of the predetermined length over which the resistance heater elements are arranged, even a large size stencil can be made without deterioration of perforations near the middle thereof.

When a stencil of a resolution not lower than 600 dpi is made, the thermal head is pressed against the platen roller under a high pressure (e.g., a linear pressure of not lower than 150 g/cm) and the platen roller is deflected as described above, which results in unsatisfactory perforations near the middle of the stencil. In accordance with the present invention, since the thermal head is convex at the middle thereof, the resistance heater elements can be kept in close contact with the stencil material even near the middle of the platen roller even if the platen roller is pressed by the thermal head under a high pressure and is deflected to be concave near the middle thereof, whereby generation of defective perforations can be suppressed and a high quality stencil can be obtained.

DESCRIPTION OF THE PREFERRED EMBODIMENT

Figure 1:
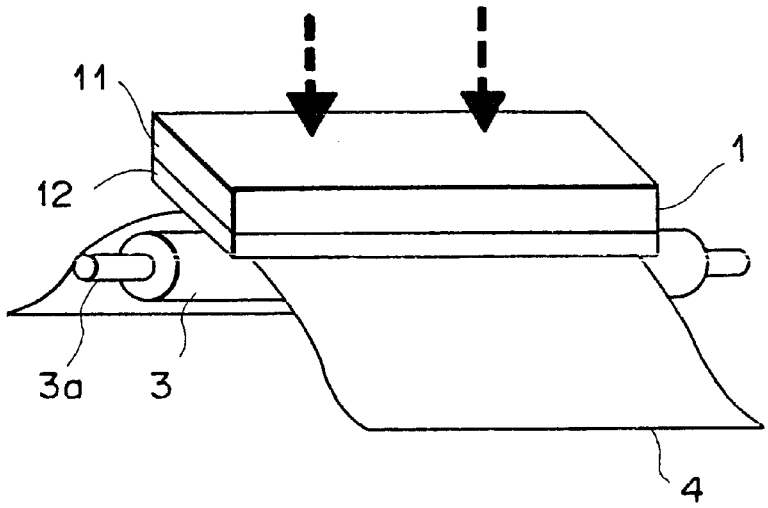
FIG. 1 is a schematic perspective view showing a stencil making apparatus in accordance with an embodiment of the present invention.

In FIG. 1, a stencil making apparatus in accordance with an embodiment of the present invention comprises a thermal head 1 and a platen roller 3. The thermal head 1 is pressed against the platen roller 3 at a linear pressure of 150 g/cm and is moved away from the platen roller 3 by a head pressing mechanism (not shown). A stencil material 4 is fed between the thermal head 1 and the platen roller 3 by a conveyor roller not shown.

The thermal head 1 comprises a heat radiating plate 11 of metal such aluminum and a ceramic substrate 12 fixed to the heat radiating plate 11, and the platen roller 3 comprises a cylindrical hard rubber roller supported by a support shaft 3 extending through the hard rubber roller along the longitudinal axis thereof. The platen roller 3 is rotated by a drive mechanism (not shown) to convey the stencil material 4 in synchronization with drive of the thermal head 1.

Figure 2:
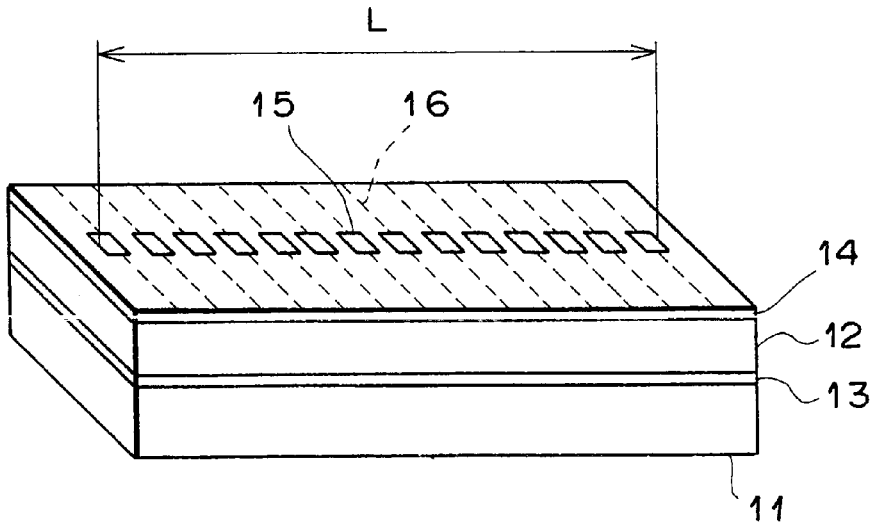
FIG. 2 is a schematic perspective view showing the thermal head employed in the stencil making apparatus.

As shown in detail in FIG. 2, the ceramic substrate 12 is fixed to the heat radiating plate 11 by a thermosetting adhesive layer 13. A glaze layer 14 60 $\mu$m thick is formed on the ceramic substrate 12, and a plurality of resistance heater elements 15 are formed on the glaze layer 14 arranged in a row in the longitudinal direction of the substrate 12. The glaze layer 14 is of glass and functions as a heat accumulating layer. The resistance heater elements 15 are arranged at a density corresponding to resolution of 600 dpi. The length L over which the resistance heater elements 15 are arranged is about 300 mm when an A3 size stencil is to be made.

Each of the resistance heater elements 15 is connected to a pair of electrodes 16 extending in a direction substantially perpendicular to the direction of arrangement of the resistance heater elements 15 and the resistance heater elements 15 are selectively energized to generate heat and thermally perforate the stencil material 4. Though not clear in FIG. 2, the thermal head 1 is convex toward the surface of the glaze layer 14 on which the heater elements 15 are formed in such an extent that the middle portion of the surface of the glaze layer 14 is higher than the end portions thereof by about 0.05 mm.

Figure 3A:
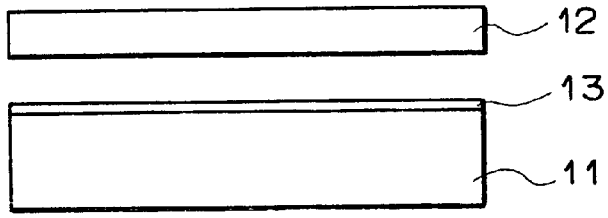
FIGS. 3A to 3C are cross-sectional views for illustrating the manufacturing process of the thermal head.
Figure 3B:
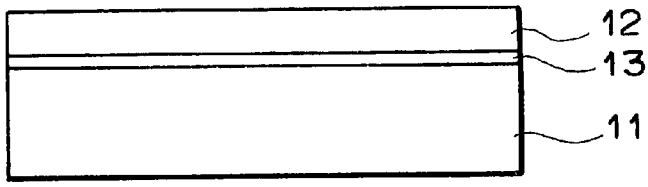

The manufacturing process of the thermal head 1 will be described with reference to FIGS. 3A to 3C, hereinbelow. As shown in FIG. 3A, a thermosetting adhesive layer 13 is formed on a heat radiating plate 11 and a ceramic substrate 12 provided with a glaze layer 14, resistance heater elements 15 and electrodes 16 is superposed on the adhesive layer 13. The heat radiating plate 11 is slightly shorter than the ceramic plate 12.

Then the assembly of the heat radiating plate 11 and the ceramic substrate 12 is left in an oven at 100° C. for two hours. At this time, the thermosetting adhesive layer 13 is gradually set and the ceramic substrate 12 is bonded to the heat radiating plate 11. Since the coefficient of thermal expansion of the ceramic substrate 12 is about $10\times10^{-6}$/° C. and the coefficient of thermal expansion of the aluminum heat radiating plate 11 is about $2300\times10^{-6}$/° C., the ceramic substrate 12 is bonded to the heat radiating plate 11 by the adhesive layer 13 with the heat radiating plate 11 expanded to a length substantially equal to the ceramic substrate 12 at a high temperature of 100° C. as shown in FIG. 3B.

Then the assembly is taken out from the oven and is left stand at a room temperature (23° C.), whereby the heat radiating plate 11 and the ceramic substrate 12 are cooled to the room temperature.

Figure 3C:
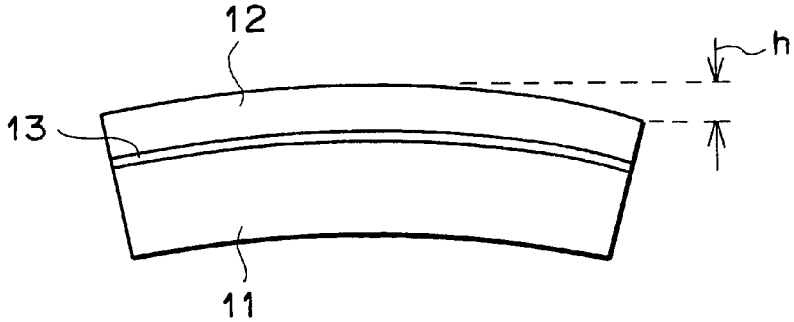

When cooled to the room temperature, the heat radiating plate 11, which is larger in coefficient of thermal expansion is, contracts more than the ceramic substrate 12, and accordingly, as the temperature of the assembly lowers, the assembly (thermal head 1) curls toward the heat radiating plate 11 and a convex thermal head 1 which is convex toward the surface of the ceramic substrate 12 on which the resistance heater elements 15 are provided is obtained as shown in FIG. 3C. In this particular embodiment, the middle portion of the surface of the glaze layer 14 on the ceramic substrate 12 is higher than the end portions thereof by about 0.05 mm (indicated at h in FIG. 3C).

The degree of convexity h can be controlled by controlling the temperature at which the thermosetting adhesive layer 13 is set, which should be set higher than the upper limit of the normal working temperature range of the thermal head 1 by at least 60° C.

Figure 4:
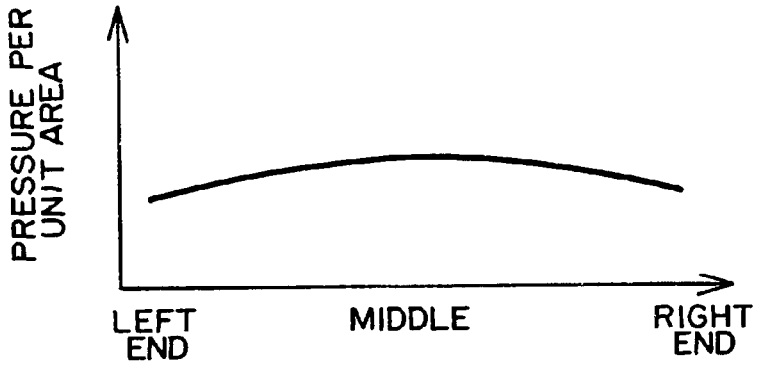
FIG. 4 is a graph showing the measured value of the pressure acting between the thermal head employed in the stencil making apparatus of the embodiment and the platen roller per unit area when the thermal head is pressed against the platen roller under a predetermined force.
Figure 5:
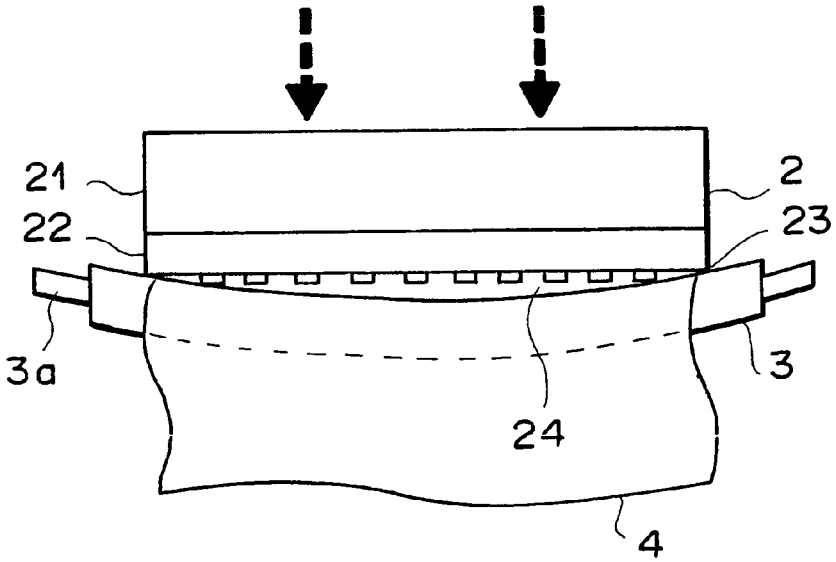
FIG. 5 is a fragmentary view for illustrating a problem in a conventional thermal head.
Figure 6:
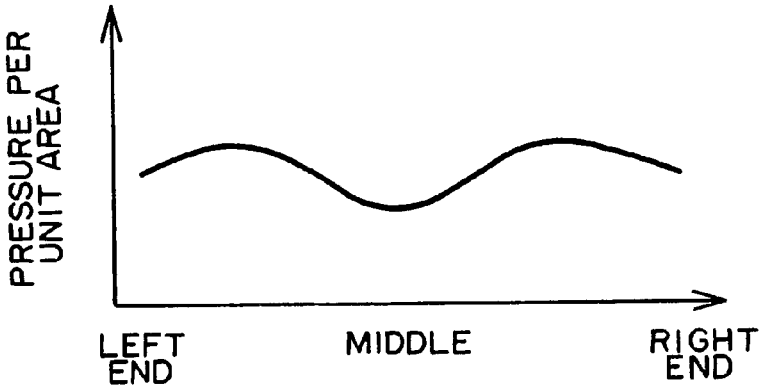
FIG. 6 is a graph showing the measured value of the pressure acting between the conventional thermal head and the platen roller per unit area when the thermal head is pressed against the platen roller under a predetermined force.

FIG. 4 is a graph showing the measured value of the pressure acting between the thermal head 1 manufactured in the manner described above and the platen roller 3 per unit area when the thermal head 1 is pressed against the platen roller 3 under a predetermined force.

As can be understood from FIG. 4, the pressure is nor reduced even at the middle portion of the thermal head 1 and accordingly, generation of defective perforations near the middle of the stencil material 4 can be suppressed. Further, since the thermal head 1 has a convexity symmetrical about the middle thereof in the direction of arrangement of the resistance heater elements 15, the pressure between the thermal head 1 and the platen roller 3 can be substantially uniform over the entire length L over which the resistance heater elements 15 are arranged, whereby the stencil material 4 can be perforated in a desirable manner.

As can be understood from the description above, in accordance with the present invention, a convex thermal head can be produced by only bonding a substrate which is smaller in coefficient of thermal expansion than a heat radiating plate to the heat radiating plate at a temperature higher than the normal working temperature range of the thermal head, and cooling the assembly of the heat radiating plate and the substrate to the normal working temperature range. Further, the degree of convexity of the thermal head can be easily controlled by suitably selecting the temperature at which the substrate is bonded to the heat radiating plate and no external force is applied to the substrate during production of the thermal head. Accordingly, the substrate and/or the glaze layer cannot be broken and a convex thermal head can be obtained without necessity of a long processing time, whereby a thermal head having a desired degree of convexity can be easily produced at low cost.

Further, since the assembly of the heat radiating plate and the ceramic substrate gradually curls in the normal working temperature range of the thermal head, a convexity which is smooth and substantially uniform in the direction of arrangement of the resistance heater elements can be obtained. Accordingly, the resistance heater elements can be kept in close contact with the stencil material even near the middle of the platen roller even if the platen roller is pressed by the thermal head under a high pressure (e.g., 150 g/cm) and is deflected to be concave near the middle thereof, whereby generation of defective perforations can be suppressed and a high quality stencil can be obtained.

Needless to say, the present invention can be applied to both a thick film thermal head and a thin film thermal head.

Further, though, in the embodiment described above, the ceramic substrate and the heat radiating plate are bonded together by thermosetting adhesive, they may be bonded in any manner so long as it can be bond them at a high temperature.

What is claimed is:

1. A method of manufacturing a thermal head comprising a heat radiating plate and an electrical insulating substrate which is provided with a plurality of resistance heater elements arranged in a direction over a predetermined length and a plurality of electrodes for energizing the resistance heater and is integrated with the heat radiating plate, the method comprising the steps of heating a heat radiating plate of metal and an electrical insulating substrate which is smaller than the heat radiating plate in coefficient of thermal expansion to a temperature higher than the normal working temperature range of the thermal head, and fixing the heated substrate to the heated heat radiating plate and cooling them so that the thermal head is convex toward the resistance heater, in a cross-section taken along a line parallel to the direction in which the resistance heater elements are arranged, in the normal working temperature range of the thermal head due to the difference in coefficient of thermal expansion between the heat radiating plate and the substrate.

2. A thermal stencil making apparatus comprising:

a thermal head including a plurality of heater elements arranged in a predetermined direction over a predetermined length, said thermal head being convex toward the heater elements in a cross-section taken along a line parallel to the predetermined direction; and a platen roller pressed against the thermal head at a linear pressure not lower than 150g/cm with a stencil material between said platen roller and said thermal head.

* * * * *